US006053347A

United States Patent [19]

Fullin

[11] Patent Number: 6,053,347

[45] Date of Patent: Apr. 25, 2000

[54] SEALING DEVICE FOR METALLIC CONTAINERS

[76] Inventor: Joe Fullin, 21 Knobhill Rd., Norwalk, Conn. 06851

[21] Appl. No.: 09/210,845

[22] Filed: Dec. 15, 1998

[51] Int. Cl.[7] ..... B65D 45/00

[52] U.S. Cl. ..... 220/246; 220/251; 220/258; 220/326

[58] Field of Search ..... 220/258, 233, 220/238, 243, 246, 247, 251, 314, 315, 322, 324, 326, 287, 906; 215/273, 280, 284–286, 290, 319

[56] References Cited

U.S. PATENT DOCUMENTS

| | | | |
|---|---|---|---|
| 731,690 | 6/1903 | Kraetzer | 215/290 X |
| 1,033,382 | 7/1912 | Carr | 215/290 X |
| 1,410,515 | 3/1922 | Saddlemire | 215/290 X |
| 1,912,850 | 6/1933 | Kuck et al. . | |
| 2,333,645 | 11/1943 | Eckman . | |
| 3,360,155 | 12/1967 | Colonna . | |
| 3,670,920 | 6/1972 | Rohrlick . | |
| 3,680,730 | 8/1972 | Schlanger . | |
| 3,727,787 | 4/1973 | Gregory | 220/243 |
| 3,800,972 | 4/1974 | Raymond . | |
| 3,858,747 | 1/1975 | Wharton | 220/243 |
| 3,982,656 | 9/1976 | Kusmierski et al. . | |
| 4,387,826 | 6/1983 | Heubl | 220/314 X |
| 4,429,804 | 2/1984 | Pease | 220/243 X |
| 4,511,057 | 4/1985 | Tontarelli . | |
| 4,630,750 | 12/1986 | Hughes . | |
| 4,749,100 | 6/1988 | Eberhart . | |
| 4,804,103 | 2/1989 | Goldberg | 220/251 |
| 4,913,304 | 4/1990 | Corey | 220/243 X |
| 5,501,357 | 3/1996 | Fullin . | |

FOREIGN PATENT DOCUMENTS

| | | | |
|---|---|---|---|
| 168408 | 6/1934 | Switzerland | 220/314 |

*Primary Examiner*—Nathan J. Newhouse
*Attorney, Agent, or Firm*—Hoffman, Wasson & Gitler

[57] ABSTRACT

A device to be applied to the top of a metallic container after the top of the container has been completely or partially removed for the purpose of preserving the unconsumed content of the container. The device includes a planar cover adapted to be fit over the top of the container. At least one retaining device operatively connected to a lever provided with a transverse rod is used to secure hook portions of the retaining member against the top rim of the container.

16 Claims, 5 Drawing Sheets

SEALING DEVICE FOR METALLIC CONTAINERS

BACKGROUND OF THE INVENTION

The popularity of beverages provided in cans has increased in the last several years. Beverages stored in these containers would include carbonated soda, beer, ice tea, or fruit juices. These containers often include a "pop top" opener allowing an individual to unseal the can and allow access to the beverage therein. Unfortunately, these "pop tops" cannot be reclosed, thereby forcing the individual either to drink the entire contents of the container or throwing away the unused liquid.

Several prior art patents including U.S. Pat. No. 2,333,645, issued to Eckman; U.S. Pat. No. 3,670,920, issued to Rohrlick; U.S. Pat. No. 3,680,730, issued to Schlanger; U.S. Pat. No. 3,982,656, issued to Kusmierski et al; U.S. Pat. No. 4,511,057, issued to Tontarelli; and U.S. Pat. No. 5,501,357, issued to Fullin have addressed this problem. For example, the patent to Rohrlick describes a sealing device for easy opening cans provided with a lever connected to a main latching member provided with a hook. The lever is also connected to a cover provided with a planar member having a hook portion. Both of these hook portions are designed to fit over the rim of a can. Therefore, when the lever is in the position shown in FIG. 2, the can is sealed. Although many of these patents endeavor to seal a can of liquid after a "pop top" has been opened, due to the structure utilized to accomplish this end, the closure structures have proved to be inadequate.

SUMMARY OF THE INVENTION

The above deficiencies of the prior art are addressed in the present invention which is directed to a device for sealing the top of a metallic food or beverage container after the container is opened and not all of the food or beverage contained therein is consumed. This is particularly true if the user is away from home and does not consume the entire contents within the opened metallic container.

The present invention employs a cover covering the top exterior surface of a metallic can. A single lever device connected to a transverse rod will allow a plurality of hooks to be forced against the outer rim of the top of the metallic container, forcing the cover against the top of the container, thereby sealing the container.

BRIEF DESCRIPTION OF THE DRAWINGS

The invention will be best understood by reference to the accompanying drawings which illustrate a preferred mode of construction by which the objects of this invention are achieved and in which.

DETAILED DESCRIPTION OF THE PREFERRED EMBODIMENT

Figure 1:
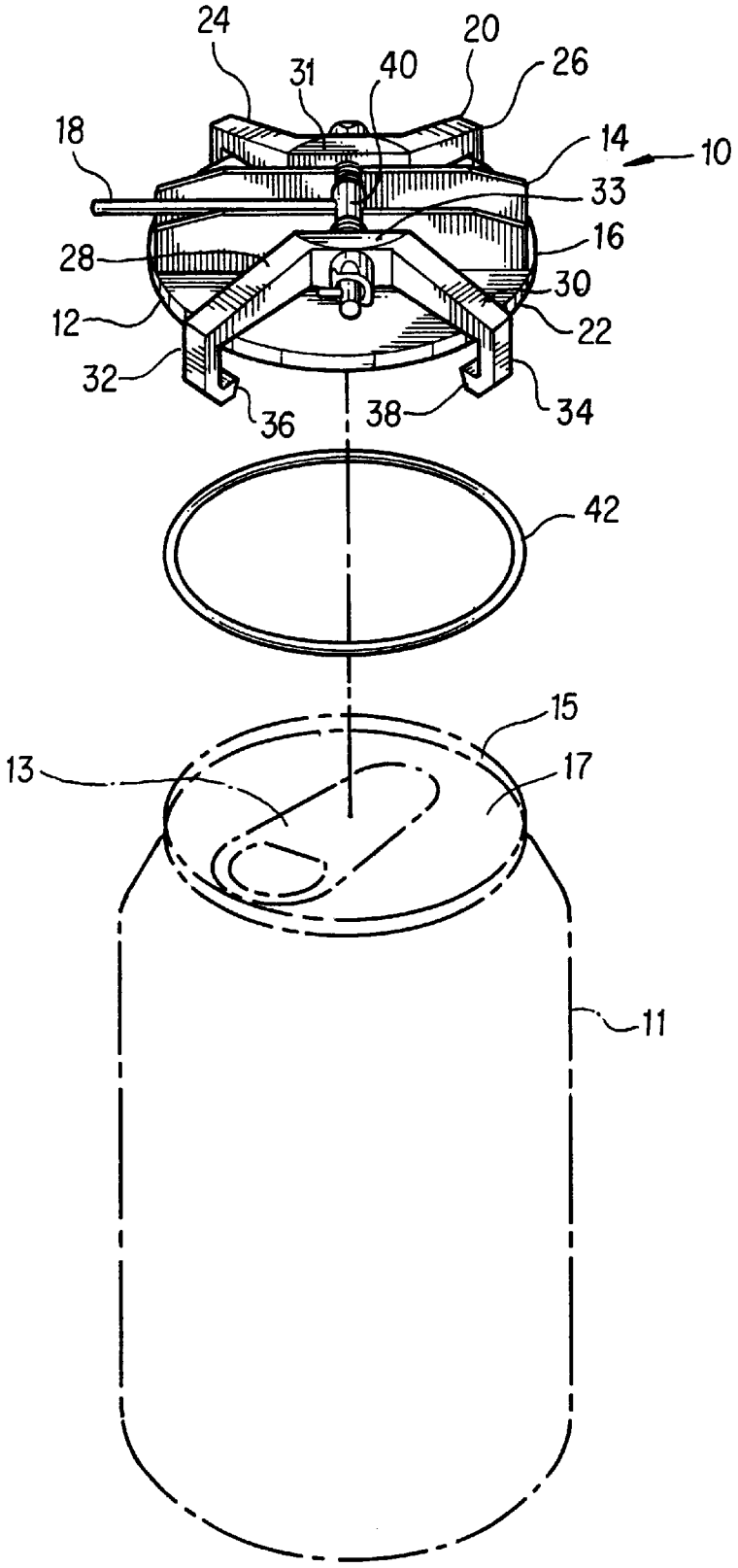
FIG. 1 is an exploded perspective view of the present invention.
Figure 2:
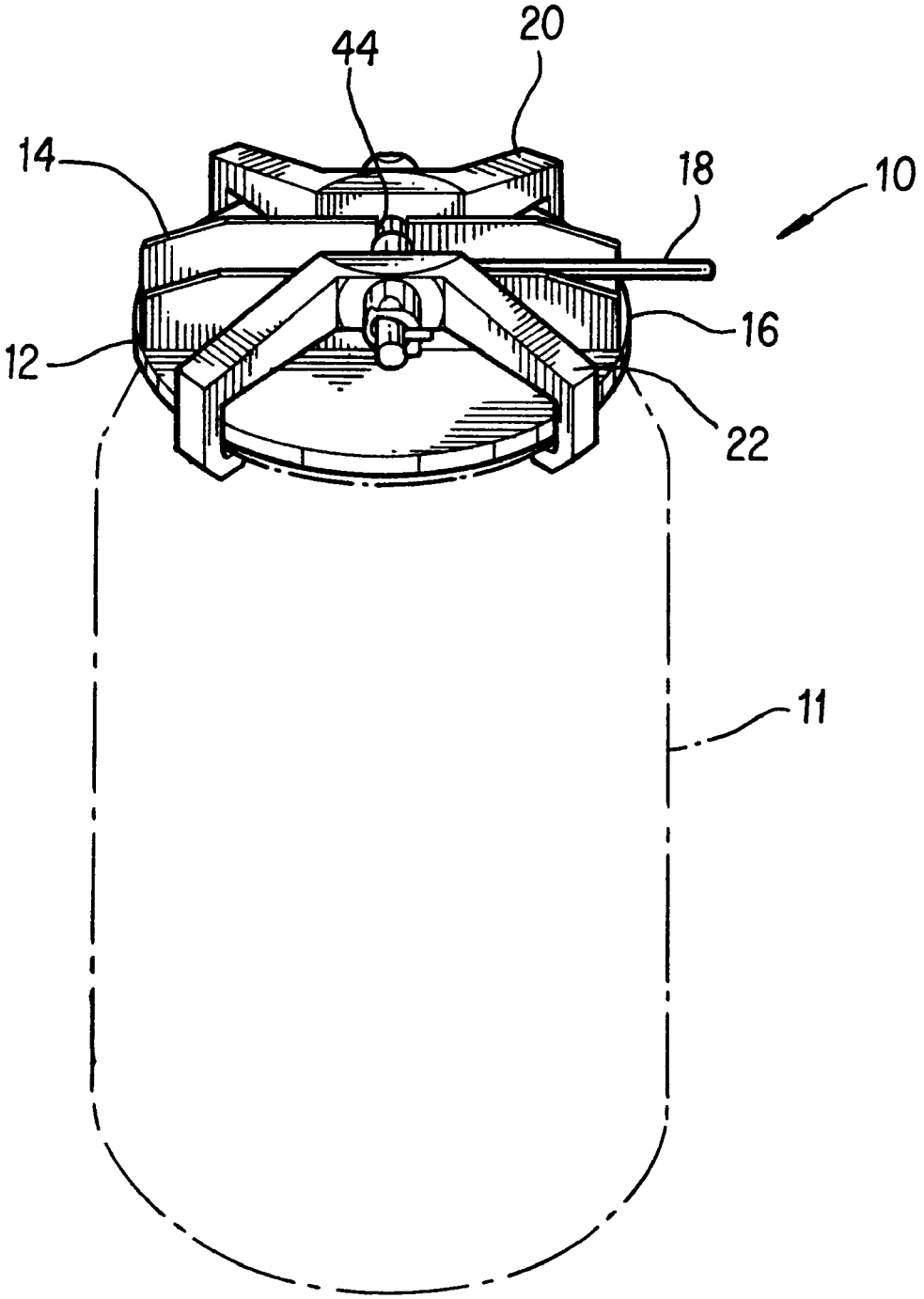
FIG. 2 is a perspective view of the present invention with the sealing device in place.

FIGS. 1 and 2 depict an exploded view of the present invention 10 as well as a view of the present invention after it has been applied to the top 17 of a metallic container having a pop top 13.

Figure 3:
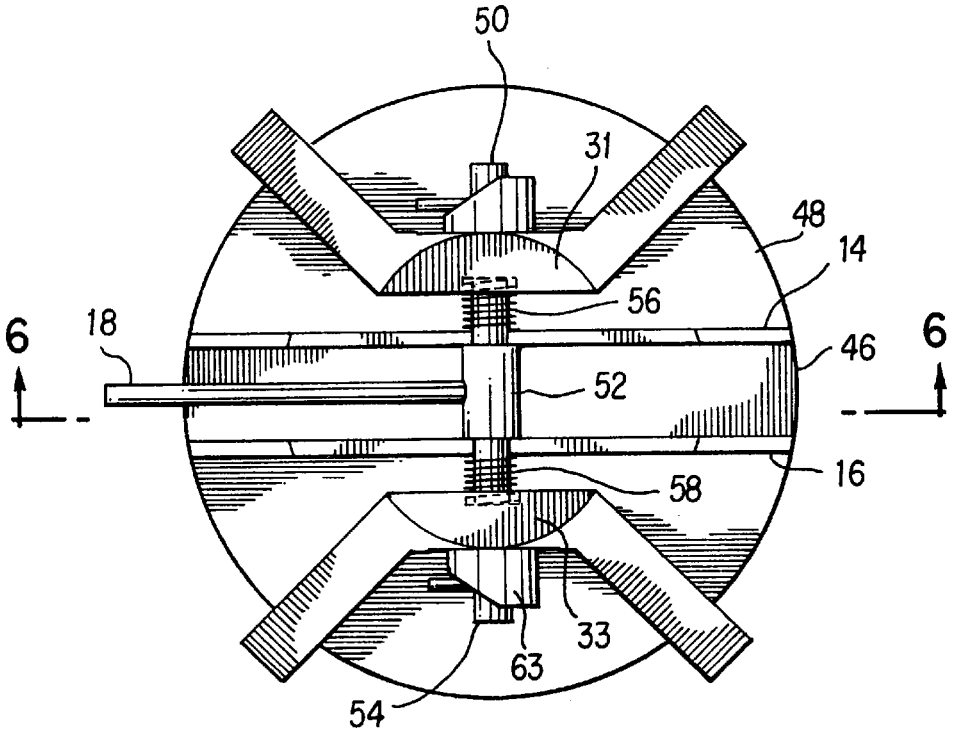
FIG. 3 is a top view of the sealing device in the open position.
Figure 4:
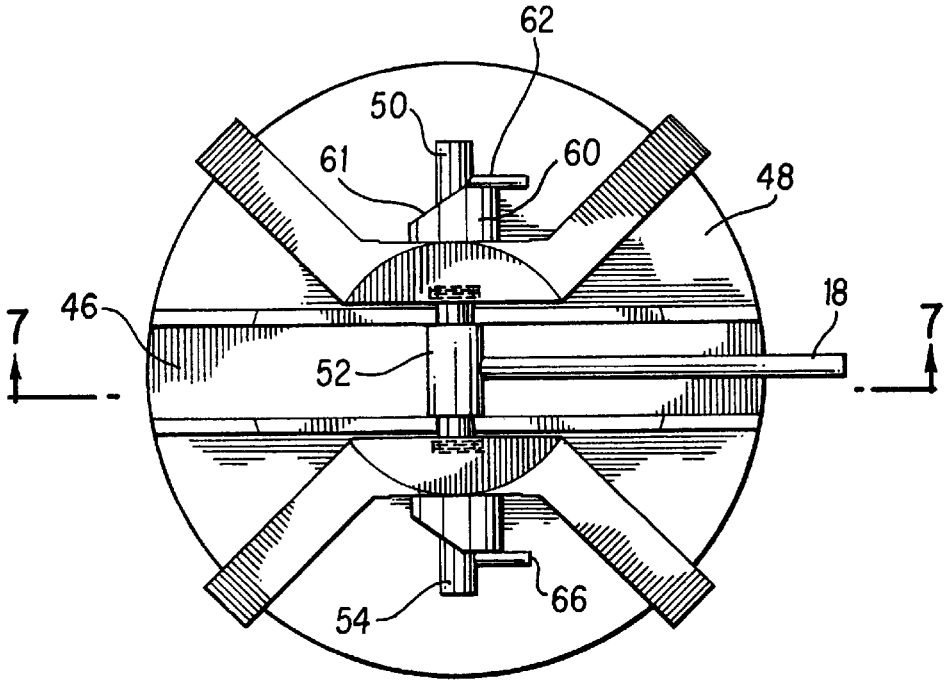
FIG. 4 is a top view of the sealing device in the closed position.
Figure 5:
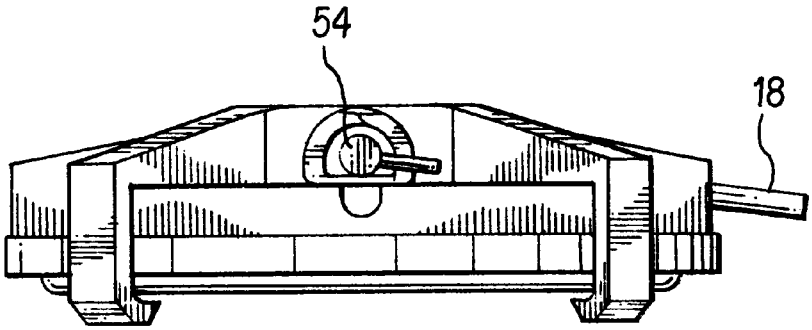
FIG. 5 is a side view of the sealing device of the present invention.

The sealing device of the present invention includes a circular cover 12 having a diameter slightly greater than the diameter of the top 17 of the metallic container. Two side members 14, 16 extend across the top surface of the cover 12, each being slightly offset from the diameter of the cover. These side members form a channel 46 therebetween (as shown in FIGS. 3 and 4). This channel 46 is at a height slightly greater than the main surface area 48 of the cover 12. A groove 44 is provided approximately at the midpoint of each of the side members 14, 16. An elongated lever 18 is connected to a transverse rod 40. The rod 40 includes a middle portion 52 to which the lever 18 is attached. The rod 40 also includes two end portions 50, 54 extending from the middle portion 52. The middle portion 52 is of greater diameter than the end portions 50 and 54 as well as being offset therefrom. This requires that each end portion 50, 54 is not connected to the center of the metallic portion, but is offset slightly from this center position as shown by offset portion 64. The length of the middle portion 52 is equal to the width of the channel 46 allowing middle portion 52 to rotate when the rod 40 is placed within the grooves 44 of their respective side members 14, 16.

Two retaining devices 20, 22 are used to retain the cover 12 in its sealing position. Retaining device 20 includes a central portion 31 parallel to the side members 14, 16. Arm portions 24 and 26 both extend at an angle from the middle portion 31 to the periphery of the cover 12. Similarly, retaining device 22 includes a middle portion 33 parallel to the side members 14, 16 and arm portions 28, 30 extending at an angle from the middle portion 33 to the periphery of the cover 12. Both of the retaining devices 20, 22 include vertical members 32, 34 extending vertically from the arm members 28, 30 respectively. Hook members 36 and 38 are designed to be forced against the rim 17 of the metallic container when the lever 18 is in the closed position, thereby sealing the cover 12 against the top surface 17 of the metallic container 11.

An O-ring 42 can be adapted to fit within a groove (not shown) on the underside of the cover 12 to aid in the sealing process. However, it is noted that O-ring 42 is not required for the operability of the present invention. Alternatively, the O-ring 42 can be directly molded to the groove on the underside of the cover 12.

Each of the retaining members 20, 22 includes a cowling 61 extending from the middle portion 31, 33. Each of the cowlings is provided with an inclined surface 61 contiguous with a horizontal surface 63. Each of the end portions 50, 54 of the rod 40 is provided with a transverse dowel 62, 66 respectively.

Springs 56, 58 can encircle a portion of the end portions 50, 54 of the rod 40 which can aid in the sealing action of the sealing device as well as to retain the rod 40 in place. It is noted that each of the springs 56, 58 are not required to operate the sealing device properly.

The operation of the sealing device 10 will now be explained particularly with respect to FIG. 3, FIG. 4, FIG. 5, FIG. 6 and FIG. 7. After the pop top 13 of the metallic container 11 has been opened and a portion of the beverage or food therein has been consumed, the present invention will operate to seal the top of the metallic container 11 as well as to preserve the food and beverages therein. This is particularly important when the contents of the metallic retainer includes a carbonated beverage. At this point, the sealing device 10 including the cover 12 is applied to the top 17 of the container 11 thereby completely covering the opened pop top 13 as well as the entire surface area of top 17. At this point, the lever 18 is in the position shown in FIGS. 3 and 6 with the offset portion 64 shown in the elevated position. Each of the dowels 62, 66 is in a position below the inclined surface 61 of the cowling. Each of the four hook portions 36, 38 extend around and under the periphery of the cover 12. Since the diameter of the cover 12 is greater than the diameter of the top surface 17 of the metallic container 11, the end surface of each of the hook members would slightly engage either the rim 15 of the container or a surface of the container 11 close to the rim 15. As illustrated in FIG. 3, each of the middle portions 31, 33 of arms 20, 22 is spaced at a distance from side members 14, 16 respectively.

Figure 7:
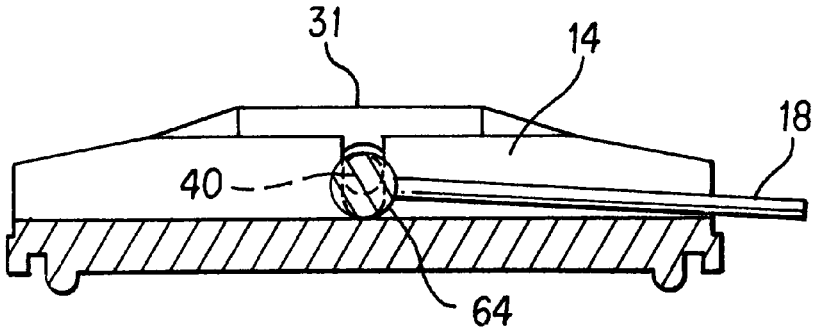
FIG. 7 is a cross-sectional view of the present invention taken through lines 7—7 of FIG. 4.

To effectively seal the sealing device 10 to the top 17 of the metallic container 11, lever 18 is rotated approximately 180° to the position shown in FIGS. 4 and 7. Due to positioning of the offset element 64 as well as the dowels 62, 66 sliding across the inclined surface 61 to the horizontal surface 65 of the cowl, each of the retaining arms 20 and 22 are forced toward their respective side members 14, 16 as well as to be slightly elevated from the top of the cover 12 as shown in FIG. 7. This movement of the retaining members 20, 22 would result in the hook members 36, 38 being forced against the rim 15 of the container 11, thereby sealing the partially consumed contents of the container 11 therein.

It is noted that the dowels 62, 66 need not travel along the entire inclined surface 61, or even a portion of the inclined surface 61. However, the dowels 62, 66 must engage the horizontal 63 as the lever 18 moves from the open position to the closed position.

The sealing device is removed by rotating the lever 18 approximately 180° from the closed portion shown in FIG. 4 to the open position shown in FIG. 3. At this point, the hooks 36, 38 would no longer engage the rim 15 and the sealing device 10 can be removed from the container top 17.

Figure 8:
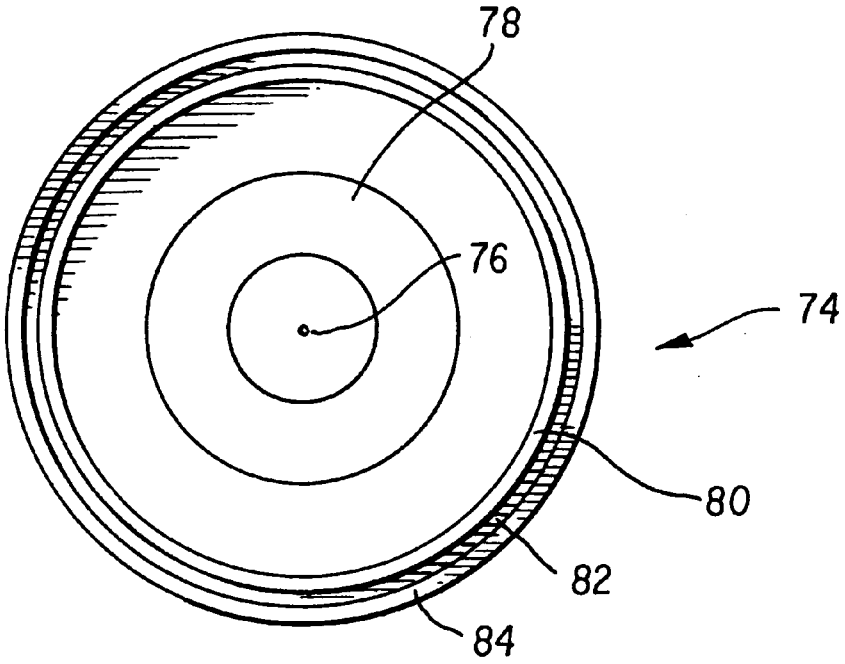
FIG. 8 is a top view of a seal used in a second embodiment of the present invention.
Figure 9:
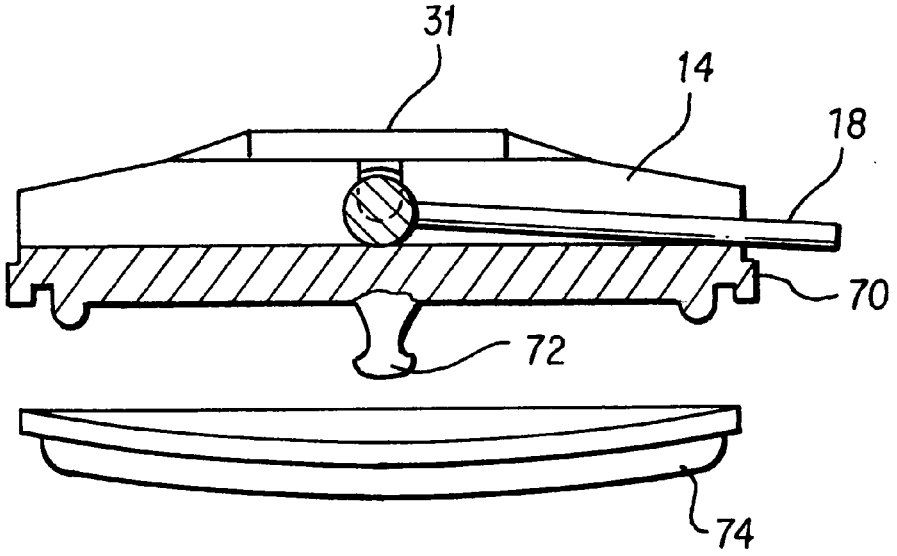
FIG. 9 is a cross-sectional view of another embodiment of the present invention taken through line 7—7 of FIG. 4 and showing the seal illustrated in FIG. 8.

A second embodiment of the present invention is illustrated with respect to FIGS. 8 and 9. This embodiment would include the utilization of a circular sealing device 74 in lieu of the gasket 49 shown in FIG. 1.

The sealing device 74 consists of a relatively thin circular disk provided with a slightly raised circular portion 78 in the middle thereof. A hole 76 is included at approximately the center portion of the raised portion 78. A ridge 80 encircles the sealing device 74 near its periphery. The height of this ridge 80 is greater than the height of the portion 78. A second ridge portion 84 encircles the sealing device 74 at its periphery. The height of this ridge 84 is less than the height of the ridge 80. A circular groove 82 is created between the two ridges 80 and 84. The edge of the ridge 84 is slightly tapered to match the slight taper (shown at 15) of a standard metallic container 11 illustrated in FIG. 1.

Figure 6:
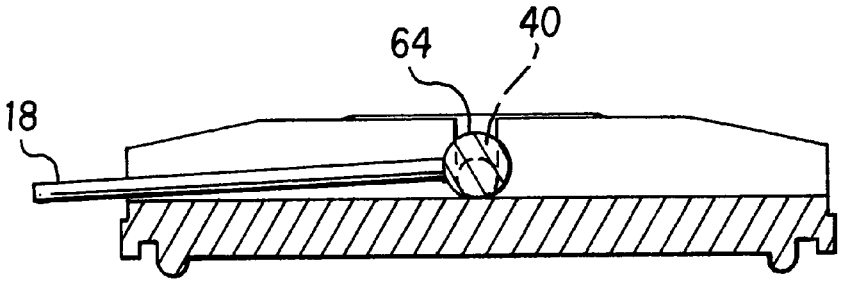
FIG. 6 is a cross-sectional view of the sealing device of the present invention taken through 6—6 of FIG. 3.

The underside of the sealing device illustrated in FIGS. 6 and 7 is modified as shown in FIG. 9. The bottom surface 70 of this sealing device includes a raised stem 72 provided approximately in the middle of the sealing device. Therefore, in use, once the top of the metallic container 11 is removed, the plastic, circular seal 74 is provided on the top surface of the metallic container 11. Thereafter, when the lever 18 of the sealing device is in the closed position as shown in FIG. 9, the stem 72 of the sealing device would be forced through the center hole 76 of the disk 24 to form a tight seal.

Although the exact materials utilized in the sealing device of the present invention are not crucial to the efficient operation of this invention, each of the materials can be constructed from various plastic materials or metallic elements, such as aluminum.

Although the present invention has been described with reference to the specific details of certain embodiments, it is not intended that such details should be regarded as limitations upon the scope of the invention except that and to the extent that they are included in the accompanying claims. For example, although the figures illustrate the present invention utilizing two retaining members 20, 22, it is noted that only one retaining member be required to operate the present invention. Additionally, it is noted that while each of the retaining members includes two hook portions, it is noted that only a single hook portion would be necessary.

What is claimed is:

1. A device for sealing the contents of a previously opened container from the environment, the container provided with a top surface, having at least a portion removed therefrom, the top surface of the container surrounded by a rim, comprising:

a cover conforming in size and shape to the top surface of the container, said cover including a top planar surface and a bottom planar surface and a periphery;

two retaining devices, each retaining device provided with a first portion overlying said cover and a second portion overlying said periphery for securing said cover to the top surface of the container; and an operating device operatively connected to said retaining devices, said operating device including a lever for movement between a first open position allowing said cover and said retaining devices to be placed over the top surface of the container, and a second closed position forcing each said second portion of said retaining devices to tightly engage the rim of the container, said operating device further including a transverse rod connected to said lever, said transverse rod including a middle portion of a first diameter and two end portions each of a second diameter smaller than said first diameter, each of said end portions inserted through one of said retaining devices.

2. The device in accordance with claim 1, wherein each of said retaining devices is provided with two second portions.

3. The device in accordance with claim 1, wherein said bottom planar surface includes a groove and further wherein an O-ring is provided is said groove.

4. The device in accordance with claim 1, further including a sealing device provided between said bottom planar surface and the top surface of the container, said bottom planar surface including a groove within which a portion of said sealing device would seat.

5. The device in accordance with claim 4, wherein said sealing device is provided with a hole approximately in the center thereof and said bottom planar surface is provided with a stem in the center portion thereof, wherein when said lever is moved between said first open position and said second closed position, said sealing device would seal the top surface of the container.

6. The device in accordance with claim 1, wherein said middle portion of said transverse rod is offset from each of said two end portions.

7. The device in accordance with claim 6 wherein each of said first portions of said retaining devices are provided with a cowl having an inclined surface and a horizontal surface and further wherein each of said end portions is provided with a transverse dowel for movement along said horizontal surface of said cowl, forcing each of said retaining devices to move toward the center of said cover, allowing each of said second portions of said retaining devices to tightly engage the rim of the container when said operating device moves between said first open position and said second closed position.

8. The device in accordance with claim 7 wherein said lever is connected to said middle portion of said transverse rod.

9. The device in accordance with claim 8 wherein said cover is provided with two parallel side members forming a channel therebetween within which said middle portion of said transverse rod rotates when said lever moves from said first open position to said second closed position, and further forcing each of said first portions of said retaining devices against one of said side members when said lever moves from said first open position to said second closed position.

10. The device in accordance with claim 9 further including a spring encircling each of said end portions between said first portion of said retaining device and one of said side members.

11. The device in accordance with claim 10, wherein said bottom planar surface includes a groove and further wherein an O-ring is provided in said groove.

12. The device in accordance with claim 1 wherein each of said first portions of said retaining devices are provided with a cowl having an inclined surface and a horizontal surface and further wherein each of said end portions is provided with a transverse dowel for movement along said horizontal surface of said cowl, forcing each of said retaining devices to move toward the center of said cover, allowing each of said second portions of said retaining devices to tightly engage the rim of the container when said operating device moves between said first open position and said second closed position.

13. The device in accordance with claim 12 wherein said lever is connected to said middle portion of said transverse rod.

14. The device in accordance with claim 13, wherein said cover is provided with two parallel side members forming a channel therebetween within which said middle portion of said transverse rod rotates when said lever moves from said first open position to said second closed position, and further forcing each of said first portions of said retaining devices against one of said side members when said lever moves from said first open position to said second closed position.

15. The device in accordance with claim 14 further including a spring encircling each of said end portions between said first portion of said retaining device and one of said side members.

16. The device in accordance with claim 15, wherein said bottom planar surface includes a groove and further wherein an O-ring is provided is said groove.

* * * * *